United States Patent [19]

Levasseur

[11] Patent Number: 4,834,689

[45] Date of Patent: May 30, 1989

[54] COIN CHANGER PAYOUT MEANS

[75] Inventor: Joseph L. Levasseur, Chesterfield, Mo.

[73] Assignee: Coin Acceptors, Inc., St. Louis, Mo.

[21] Appl. No.: 7,777

[22] Filed: Jan. 28, 1987

[51] Int. Cl.[4] ..... G07D 1/00

[52] U.S. Cl. ..... 453/21; 453/41; 453/37

[58] Field of Search ..... 453/19–21, 453/23–26, 18, 29, 37, 38, 39, 40, 43–45, 41; 221/124, 126, 127

[56] References Cited

U.S. PATENT DOCUMENTS

| | | | |
|---|---|---|---|
| 542,328 | 7/1895 | Brandt | 453/38 X |
| 3,278,077 | 10/1966 | Schmermund | 221/124 X |
| 3,738,377 | 6/1973 | Lotspeich . | |
| 4,080,973 | 3/1978 | Kobayashi | 453/44 X |
| 4,126,147 | 11/1978 | Brisebarre et al. | 453/22 X |
| 4,250,905 | 1/1981 | Kobayashi . | |
| 4,284,093 | 8/1981 | Hayashi | 453/21 |
| 4,361,161 | 11/1982 | Johnson . | |
| 4,392,505 | 7/1983 | Maloney et al. . | |

FOREIGN PATENT DOCUMENTS

| | | | |
|---|---|---|---|
| 107321 | 8/1967 | Denmark | 453/20 |
| 0139544 | 5/1985 | European Pat. Off. | 453/20 |
| 1249574 | 11/1960 | France | 453/21 |
| 2045217 | 10/1980 | United Kingdom | 453/21 |

*Primary Examiner*—Joseph J. Rolla

*Attorney, Agent, or Firm*—Cohn, Powell & Hind

[57] ABSTRACT

The payout mechanism is for use with a relatively large number of coin changer storage tubes of the type having a reciprocating payout slide for dispensing coins from the tube. The payout mechanism includes a plurality of connection members each connected between an associated payout slide and a rotatable drive shaft. In one embodiment the connection members include first latch portions which are longitudinally spaced relative to the drive shaft and angularly spaced relative to each other and second latch portions which are engageable with the payout slides and are selectively connectible to associated first latch portions. A reversible electric motor is used to rotate the first latch portions on the drive shaft into alignment with the second latch portion and to oscillate the drive shaft and thereby reciprocate the payout slide when the selected latch portions are moved into connected engagmeent by a solenoid. A control system is provided for controlling rotation and oscillation of the electric motor and energizing of the solenoid. The payout slides are overlapped to provide a more compact assembly.

25 Claims, 5 Drawing Sheets

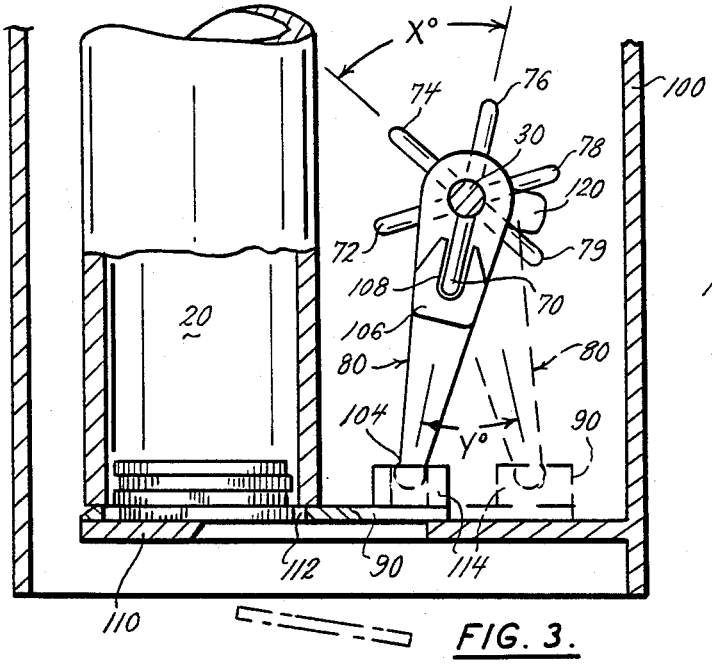
FIG. 3.
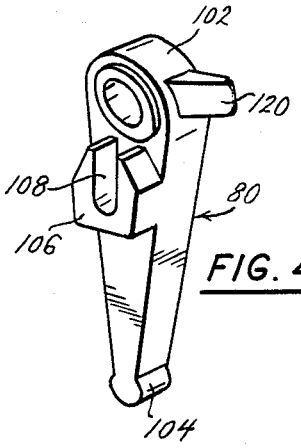
FIG. 4.
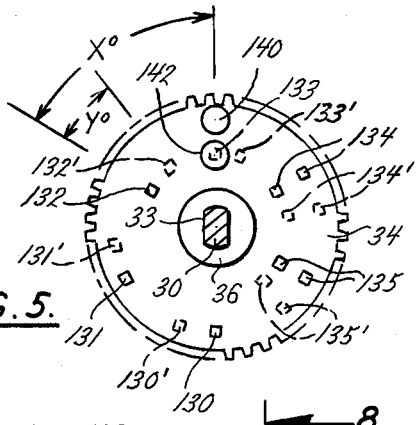
FIG. 5.
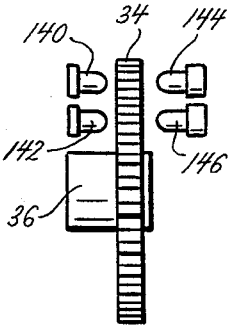
FIG. 6.
FIG. 8.
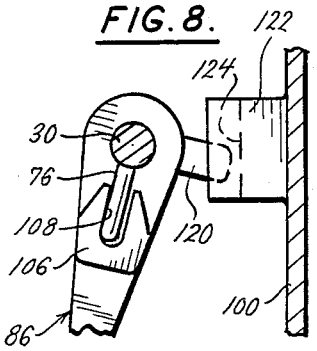
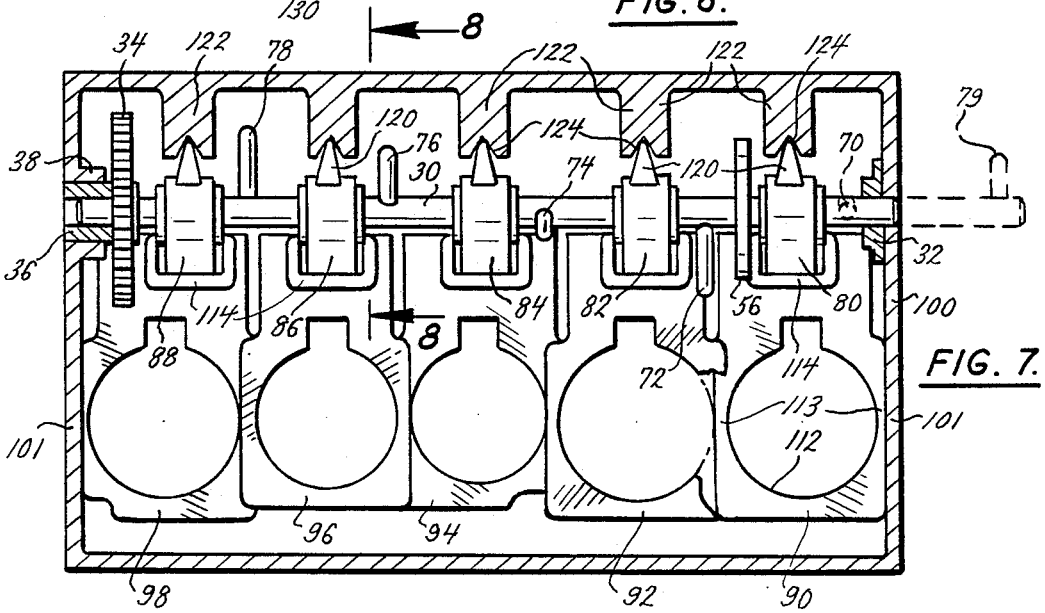
FIG. 7.

FIG. 15.
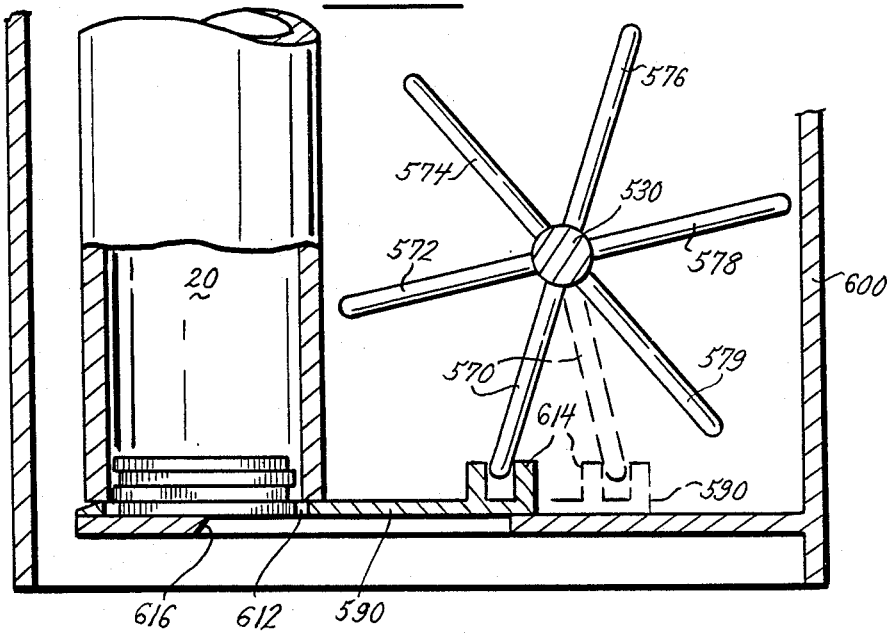
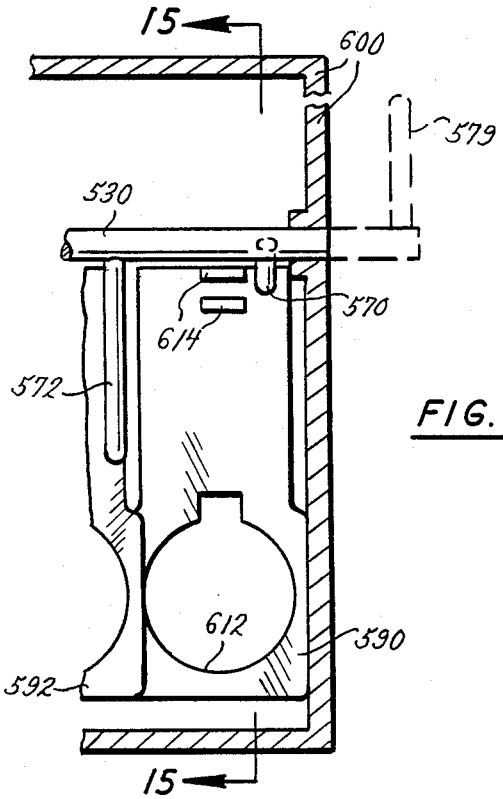
FIG. 14.

COIN CHANGER PAYOUT MEANS

BACKGROUND OF THE INVENTION

This invention relates generally to coin changers for vending machines and more particularly to an improved payout means for use with such changers.

Coin changer payout means of the type under consideration are intended for use with coin changers of the general type described in U.S. Pat. No. 3,175,670. Such changers are used, in part, for separating acceptable coins into their respective denominations as they pass downwardly in predetermined paths through the changer for storage in vertical storage tubes for making change and, when the tubes are filled, for directing such coins into a cash box. A counting device receives pulses from coin switches or acceptor logic and programs the mechanism for paying out correct change when the deposit is greater than the merchandise vend price or for returning the deposit if the transaction is cancelled.

Payout means for coin changers are well-known in the prior art and one of the disadvantages of typical payout systems is that each of the coin storage tubes is provided with its own individual mechanism and circuitry to provide for dispensing coins from a selected coin tube. This has led in particular to the provision of multiple solenoid use resulting in complicated operating mechanism with a proportionately high probability of failure. Also, the necessary use of a relatively high-powered spring with each solenoid is a disadvantage. In addition, the need for compactness of payout systems in existing and conventional housing results in considerable installation problems since space is of a premium in vending machines which use coin changers to the type under consideration.

The present invention solves the above and other problems in a manner not revealed by the known prior art.

Where common drive shafts have been used, such as disclosed in U.S. Pat. No. 3,738,377, the mechanism has generally been limited to only two coin storage tubes and is unsuitable for use with requirements of four or more coin storage tubes which is desirable particularly with currencies having a wide range of coin denominations and for volume of coins to be paid out.

SUMMARY OF THE INVENTION

This coin changer payout means provides a payout mechanism for dispensing coins from five or more storage tubes without the need for multiple spring-loaded solenoids and associated circuitry. In addition, by eliminating duplication of solenoids and related parts, the mechanism, even though servicing an unusually large number of coin storage tubes, can be housed within the size limitations imposed by conventional coin changer requirements.

It is an aspect of this invention to provide a coin changer payout means which includes a plurality of coin storage tubes disposed in adjacent relation; a plurality of reciprocating payout slides each associated with a coin storage tube and being movable between a coin receiving position and a coin releasing position; a rotatable drive means; a plurality of connection means, each of said connection means being selectively connectible between the drive means and an associated payout slide; means for rotating the drive means into a connectible condition with a selected payout slide; means for moving the drive means and the selected payout slide into connected engagement; means for oscillating the drive means to reciprocate the selected payout slide, and control means for controlling rotation and oscillation of the drive means and movement of the shaft and payout slide into the connected condition.

In one aspect of the invention the drive means is a drive shaft means having a longitudinal axis.

It is another aspect of this invention to provide that the means for rotating and oscillating the shaft includes motor means.

Still another aspect of this invention is to provide that the motor means includes a reversible DC motor and transmission means between the motor and the drive shaft means. Yet another aspect of this invention is to provide that the motor means includes a stepper motor.

Still another aspect of this invention is to provide that the means for moving the shaft and the selected payout means into connected engagement includes means shifting the shaft means relative to its longitudinal axis.

In yet another aspect of this invention the shifting means includes a solenoid.

Another aspect of this invention is to provide that the connection means includes a first engagement means, said first engagement means being disposed on the shaft means in longitudinally spaced relation to each other and in selected angular relation to each other relative to the longitudinal axis of the shaft means, and a second engagement means engageable with an associated payout slide and movable into connected engagement with the first engagement means by the moving means.

It is another aspect of this invention to provide that the means for moving the first and second engagement means into connected engagement includes a solenoid.

Still another aspect of this invention is to provide that one of the first and second engagement means includes a latch element and the other of said first and second engagement means includes a latch slot receiving the latch element.

It is an aspect of this engagement means to provide that each connection means includes a latch element said latch elements being disposed on the shaft in longitudinally spaced relation to each other and in selected angular relation to each other relative to the longitudinal axis of the shaft and being movable into connected engagement with an associated payout slide by the moving means.

It is another aspect of this invention to provide that each latch element is provided by an outwardly extending pin and each payout slide includes a latch slot receiving an associated latch pin in connected engagement.

It is another aspect of this invention to provide that the means for moving the first engagement means into selected engagement with the second engagement means includes a pivoted positioning lever operatively engageable with the shaft means and means operatively connected to the positioning lever to pivot said lever.

Yet another aspect of this invention is to provide that the second engagement means are mounted to the shaft means in freely rotatable relation when the first and second engagement means are disengaged.

It is another aspect of this invention to provide that the shaft means includes a plurality of outwardly extending eccentric members each having a latch portion providing a first engagement means and each second engagement means includes a link having a latch portion engageable with the latch portion of the first engagement means.

Still another aspect of this invention is to provide a separate shaft disposed in spaced parallel relation to the drive shaft and the second engagement means are mounted to the separate shaft in freely rotatable relation when the first and second engagement means are disengaged.

Yet another aspect of this invention is to provide that the control means includes encoding means rotatable with the shaft means and having a plurality of encoding circumferentially disposed apertures and cooperating light emitting diodes on one side of said means and phototransistors on the other side of said means.

It is another aspect of this invention to provide that the motor means includes a transmission means including a drive gear mounted to the drive shaft, said drive gear providing the encoding means.

Still another aspect of this invention is to provide that the payout slides include opposed end slides and at least one intermediate slide, said intermediate slide having a slide on each side thereof disposed in transverse lapped relation thereto.

Yet another aspect of this invention is to provide that the payout slides between opposed housing sidewalls are disposed in lapped relation so that the cumulative sum of the payout slide aperture diameters and the side portions of all slides is greater than the distance between said sidewall portions thereby effectuating considerable space saving providing a more compact assembly.

It is yet another aspect of this invention to provide a coin changer payout means which is relatively simple and inexpensive to manufacture and highly efficient in operation at least in part because of the weight reduction and energy saving resulting from the elimination of multiple solenoid use.

BRIEF DESCRIPTION OF THE DRAWINGS

FIG. 3 is a sectional view taken on line 3—3 of FIG. 2;

FIGS. 4 is a perspective view of the latchable member;

FIG. 5 is a sectional view taken on line 5—5 of FIG. 1 showing the encoded gear;

FIG. 6 is a side view respectively of the encoded gear;

FIG. 7 is a sectional plan view taken on line 7—7 of FIG. 1 with parts removed for clarity;

FIG. 8 is a sectional view taken on line 8—8 of FIG. 7;

FIG. 14 is a fragmentary view similar to FIG. 7 of another modified payout means, and FIG. 15 is a sectional view taken on line 14—14 of FIG. 13.

Figure 1:
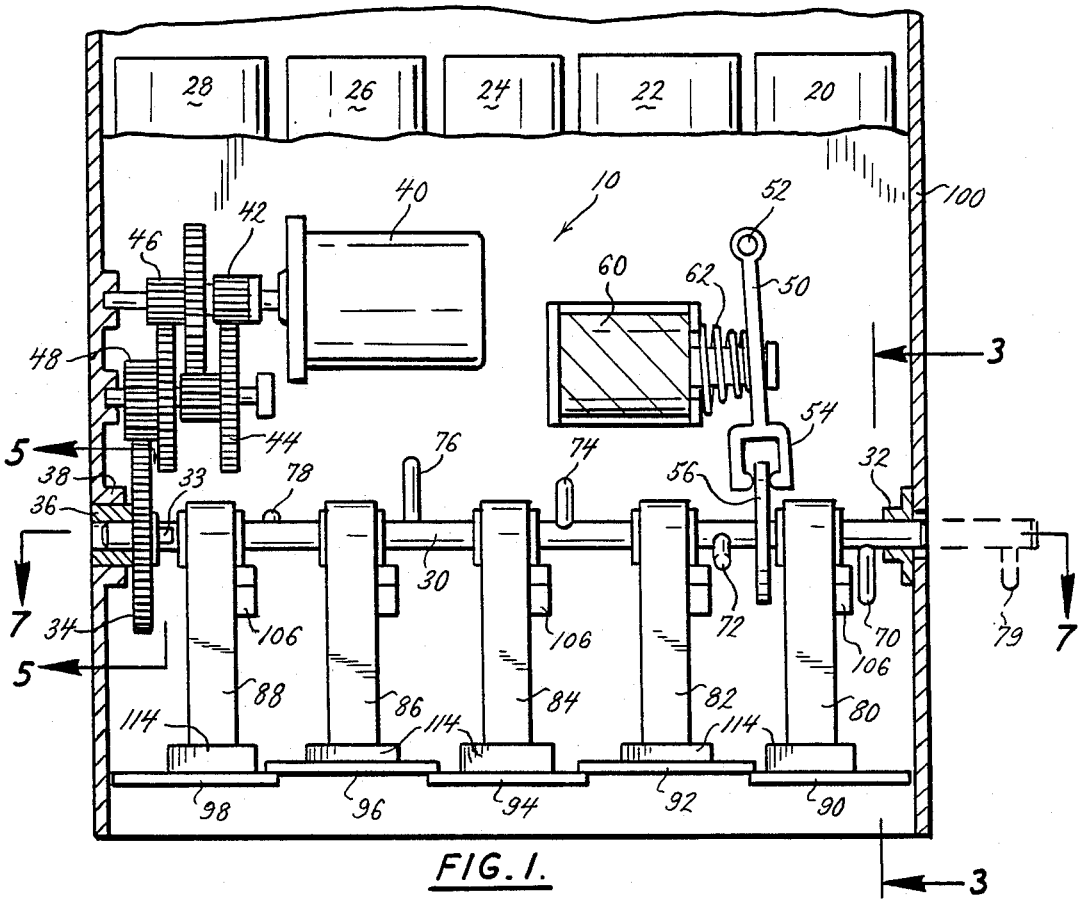
FIG. 1 is an elevational view of the coin changer payout means with the drive shaft shown in one position.

DESCRIPTION OF THE PREFERRED EMBODIMENT:

Referring now by reference numerals to the drawings and first to FIGS. 1–3 and 7 it will be understood that the coin changer payout mechanism, generally indicated by 10 is mounted in the lower portion of a coin changer housing 100 and, in the preferred embodiment, services a plurality of coin storage tubes 20, 22, 24, 26 and 28. The payout mechanism is intended for use, by way of example, with a coin changer of the type disclosed in U.S. Pat. No. 3,175,670 which is incorporated by reference in the specification herein.

It will be understood that the number of coin tubes which can be serviced depends on the space available within the housing 100 and the diameter of the coins. In the embodiment shown a set of five (5) tubes are shown which accomodate coins whose cumulative diameter dimensions do not exceed the lateral space requirements.

Essentially, as will now be described, a series of payout units are provided each consisting of a coin storage tube, a payout slide constituting a coin dispensing means, and being movable from a coin receiving position to a coin releasing position, and associated payout mechanism, the payout mechanism being selectively operated by a master drive shaft controlled by a control system.

As shown in FIG. 1 a drive shaft 30, constituting a drive means, is mounted at one end to the sidewall of the housing 100 by means of a bearing 32. At the other end the drive shaft 30 is mounted to the sidewall of the housing indirectly through the medium of a driver gear 34 having a boss 36 which is mounted to a bearing 38 formed in the sidewall. To this end, the drive shaft 30 includes a flat 33 which is keyed within the boss 36 to permit axial shifting movement of said shaft relative to said boss while at the same time providing for rotation of the shaft 30 by the driver gear 34. The shaft 30 is rotatively driven by motor means which include a reversible D.C. motor 40, mounted to the housing 100 and transmission means provided by speed reduction gear 42, 44, 46 and 48 engageable with driver gear 34. This arrangement provides that the shaft 30 can be rotated either clockwise (CW) or counterclockwise (CCW). Alternatively, and if desired a stepper motor can be used thereby simplifying or eliminating shaft encoding means.

Figure 2:
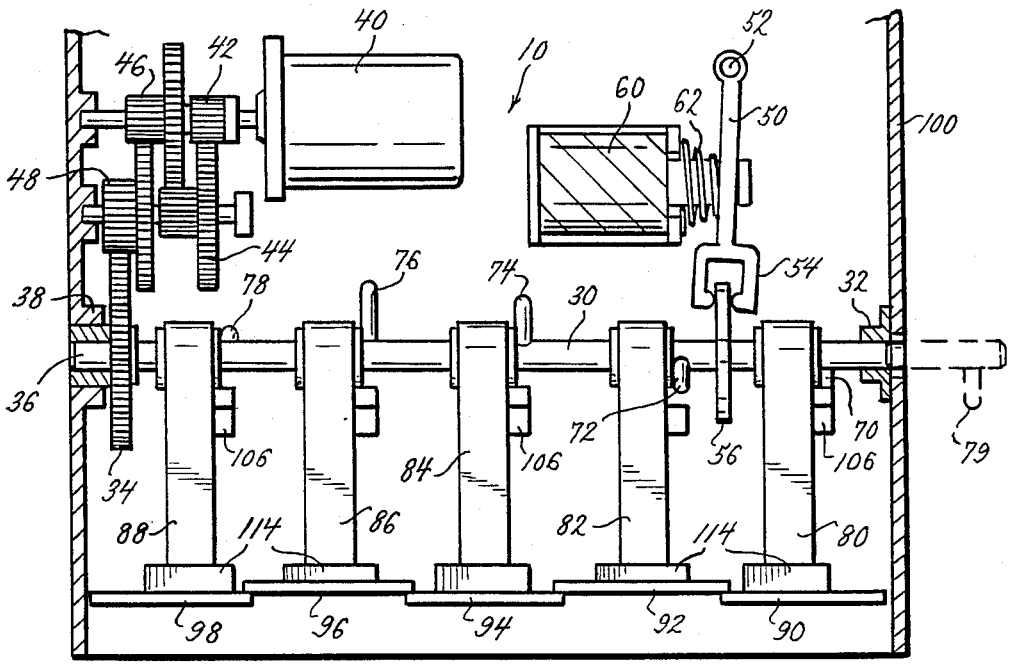
FIG. 2 is a similar view to FIG. 1 with the drive shaft shown in a shifted position.

In the embodiment shown the shaft 30 is shifted from a first position, shown in FIG. 1, to a second position shown in FIG. 2 by means of a positioning lever 50 which is pivotally mounted to the housing 100 at its upper end by means of pivot shaft 52 and includes a bifurcated lower end 54 which engages a collar 56 fixedly attached to the shaft 30. The positioning lever 50 is pivoted from the first position, shown in FIG. 1 to the second position shown in FIG. 2, by means of a solenoid 60 mounted to the housing 100. Movement from said first to second positions is experienced when the solenoid 60 is energized. A return spring 62 causes the opposite movement of the positioning lever 50 when the solenoid 60 is de-energized.

The shaft 30 includes a plurality of longitudinally spaced, radially outstanding latch elements in the form of pins 70, 72, 74, 76, 78 and 79 disposed in angular relation to each other about the shaft axis and constituting first engagement means. In the embodiment shown, five (5) latch pins are provided within the housing 100 at equal angles of sixty degrees (60°) and each pin is selectively engageable with an adjacent latchable member 80, 82, 84, 86 and 88 providing a second engagement means. Each latchable member is carried in freely rotatable depending relation by the shaft 30 unless latched to the associated latchable member as will be described. The additional pin 79 also spaced at an angle of sixty degrees (60°) is reserved for an additional coin handling function which need not be described herein.

Each latchable member is associated with a corresponding payout slide 90, 92, 94, 96 and 98 and by this structural arrangement of parts a single latch pin e.g. latch pin 70 can be engaged with its associated latchable member 80, to operate the associated payout slide 90 and thereby dispense coins from the selected storage tube 20 when the latch pin 70 is properly aligned with a corresponding latch portion provided on the associated latchable member 80 and the drive shaft 30 is shifted to the left relative to the latchable member to connect the latch pin 70 and the latchable member 80. It will be understood that when the latch pin 70 is conditioned for engagement all other latch pins are out of alignment with their associated latchable members.

More specifically the manner in which payout is achieved is best understood by reference to FIG. 3 and FIG. 4 which illustrates the mechanism used to dispense coins from storage tube 20. It will be understood that the description of payout mechanism parts to dispense coins from storage tube 20 applies equally to the other storage tubes and for this reason similar parts where appropriate, are given the same reference numeral.

As shown in FIGS. 3 and 4 the latchable member 80 includes an apertured upper end 102 slidably receiving the drive shaft 30, a cammed lower end 104 and an outstanding member 106 having a cooperating latch slot 108 receiving the latch pin 70 in connected, latched engagement. By this structural arrangement of parts the latch pin 70 and the latchable member 80 constitute means connecting the shaft 30 to the payout guide 80.

The payout slide 90, which is mounted in sliding relation to a base plate 110 includes a payout aperture 112 at one end receiving a single coin at the bottom of the coin stack in the storage tube 20. As best shown in FIG. 7, the payout aperture is flanked by side portions shown typically by numeral 113 so that adjacent slides are disposed in lapped relation to each other. At the other end the payout slide 90 includes a cam-receiving pocket 114 which receives and, in effect connects the cammed end 104 of the latchable member 80 to the associated payout slide 90. This engagement occurs when the latchable latch pin 70 and latch slot of the selected latchable member 80 are aligned and the shaft 30 is shifted to the left. As shown in phantom outline in FIG. 3 rotation of the shaft 30 a predetermined amount results in movement of the payout slide 90 from the first position shown, to a second position shown in phantom outline. Such movement of the payout slide 90 carries the lowermost coin into the dispensing area 116. Because of the use of the reversible motor 40, the shaft 30 and the selected latchable member 80, engaged by the latch pin 70, can be oscillated by alternately changing the torque direction to reciprocate the associated payout slide 90, each cycle releasing a coin from the storage tube 20. When the required number of coins is dispensed the motor 40 is stopped, the solenoid is de-energized and the shaft 30 is automatically shifted axially to the right to return to its unlatched position.

When it is desired to dispense coins from another selected storage tube, for example tube 24, the shaft 30 is rotated through the desired angular movement. For example, to align the latch pin 74 with the adjacent actuating member 84 it is necessary to rotate the shaft clockwise an amount equal to one hundred twenty degrees (120°) i.e. two times the incremental angle of sixty degrees (60°) between latch pin 80 and latch pin 84. The solenoid 60 is then energized so that said latch pin 74 engages the associated latch slot 108 of actuating member 84. Reversible rotation of the motor 40 and therefore oscillation the latch-engaged latchable member 84 results in reciprocating motion of the payout slide 94 to dispense coins from the storage tube 24. It will be understood that with the structural arrangement of parts shown the oscillation of the shaft 30 must be substantially less than sixty degrees (60°) so as to avoid interference by those pins not in a latched condition with their associated adjacent latchable members.

As discussed above, there is relative shifting between the shaft 30 and the latchable members 80–88 carried by said shaft. In order to permit such shifting it is necessary to hold the latchable members in place while the shaft is axially moved to maintain said members in alignment with the payout slides. In the preferred embodiment, as best shown in FIGS. 7 and 8, this is achieved by providing each latchable member with an alignment pin 120 which is received within a groove 124 provided in a bracket 122 forming part of the housing 100.

Rotation of the drive shaft 30 to its proper angular position to latch the selected pin and latchable member and oscillation of the shaft 30, once the selected pin and latchable member have been latched, to reciprocate a selected payout slide and dispense coins from an associated storage tube, is achieved in the embodiment described by a control means which includes the use of encoded means. In the embodiment described the encoded means is provided by the driver gear 34 includes a plurality of encoding apertures. This arrangement is best shown by reference to FIGS. 5 and 6 and provides information with respect to the rotational position of the shaft in multiples of angle X° which in the embodiment shown is sixty degrees (60°) to provide latch engagement with the selected payout slide and to monitor the payout cycles.

Driver gear 34 is provided with a set of apertures shown in one position in full lines and a second position in broken lines respectively. The set of apertures 130–135 are disposed generally at sixty degrees (60°) to each other, singly or in pairs, and consist of two apertures 130 and 131 disposed on an outer circle concentric with the axis of rotation of the shaft 30; two apertures 132 and 133 disposed on an inner concentric circle; one pair of apertures 134, one of the pair being disposed on the inner concentric circle and one of the pair on the outer concentric circle and one pair of apertures 135, one of the pair being disposed on the inner concentric circle and one of the pair being disposed on the outer concentric circle. The apertures in their second position are indicated by the same reference numerals with a prime suffix i.e., 130′–135′, out of phase by an angle Y°. This angle is chosen to suit the required angle of oscillation of the shaft 30 to provide the reciprocation of the payout slides. Angle Y° is about twenty-five degrees (25°) in the embodiment shown and indicates the amount of oscillative movement required to reciprocate a payout slide sufficiently to dispense one or more coins.

As shown by reference to FIGS. 5 and 6 light emitting diodes 140 and 142 are located on the outer and inner concentric circles respectively on one side of the driver gear 34 and correspondingly placed photo transistors 144 and 146 are disposed on the other side of said driver gear. The apertures 130–135 are located to allow light to reach photo transistor 144 or 146 or both together and information is thereby provided from one of three possible conditions. Since each aperture location in the first set of apertures is repeated once at an interval of sixty degrees (60°), information is provided regarding six (6) conditions, if it is recorded that the same condition has occurred for the first time or the second time during rotation of the drive gear 34.

Figure 9:
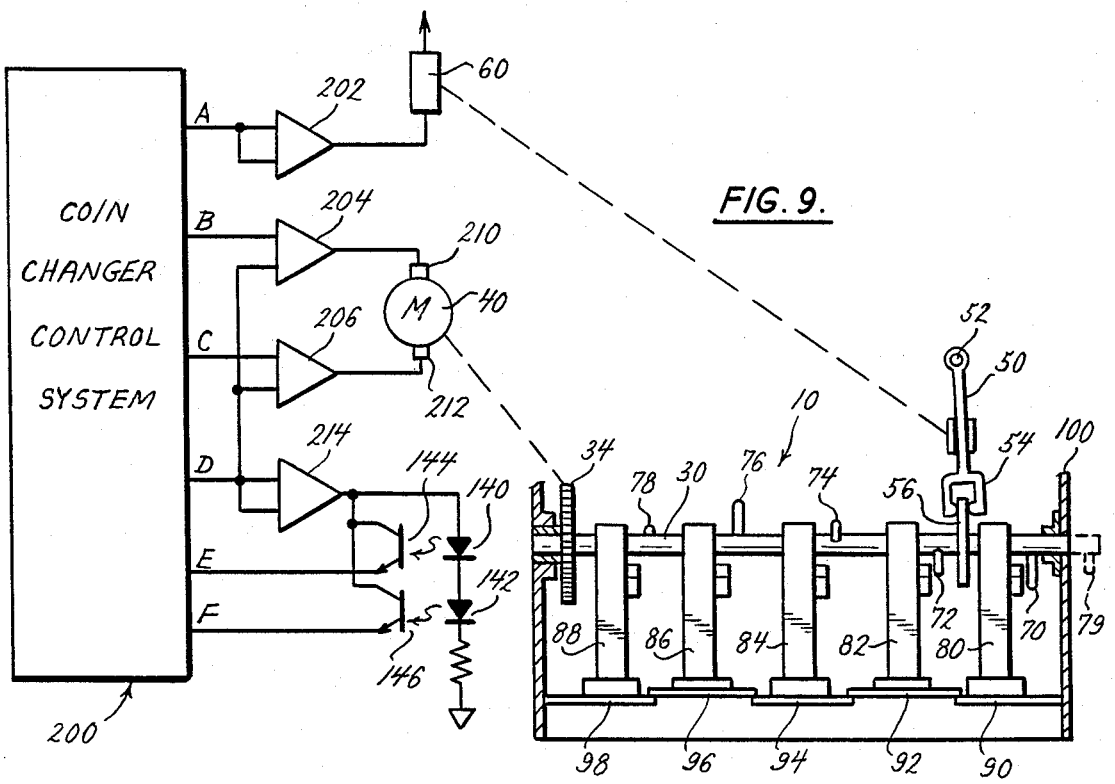
FIG. 9 is a generally schematic view showing the control system.
Figure 10:
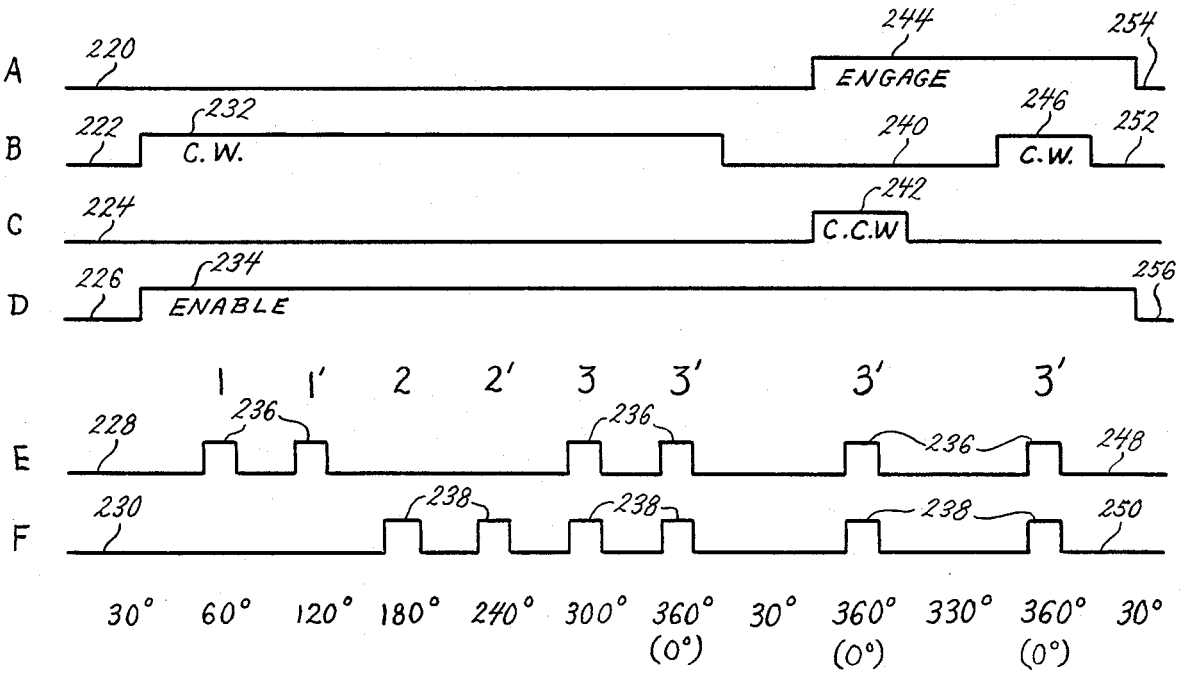
FIG. 10 is a waveform schematic illustrating the operation of the control system.

The overall control means for the payout mechanism is shown, schematically in part, in FIG. 9 and associated waveform diagrams are shown in FIG. 10.

Referring first to FIG. 9 it will be understood that this figure illustrates the electro-mechanical connection between a coin changer control system indicated by numeral 200 and the payout mechanism 10. As clearly shown the drive gear 34 is connected to the motor 40 and the positioning lever 50 is connected to the solenoid 60 by dashed lines. Controlled rotation and shifting of the shaft 30 reciprocates selected payout slides 90–98 throught the connection of latch pins 70–78 with associated latchable members 80–86. The light emitting diodes 140 and 142 and the light receiving photo-transistors 144 and 146 are shown by schematic circuitry only.

In the embodiment shown, the coin changer control system 200 provides outputs A-D and inputs E and F all of which control and monitor the operation of the payout means 10 located in the lower portion of the housing 100.

As shown in FIG. 9 output A, when HIGH (positive potential), energizes the solenoid 60 through buffer driver 202. Energizing the solenoid operates the positioning lever 50 causing an axial shift in the drive shaft 30 with the result that a selected latch pin, e.g. latch pin 70, engages its associated latchable member 80.

Outputs B and C are sequenced together with output D to cause current to be applied to the reversible motor 40 to produce clockwise (CW) or counter clockwise (CCW) rotation. This is accomplished by buffer drivers 204 and 206. Applying a HIGH at motor terminal 210 and a LOW at terminal 212 produces clockwise rotation. Applying a LOW at terminal 210 and a HIGH at terminal 212 produces counter clockwise rotation.

FIG. 10 is a waveform diagram showing the outputs of lines E and F which provide the coin changer control system 200 with information related to the rotational position of the drive gear 34 via 144 and 146 and therefore the shaft 30 to which it is keyed. The buffer drive 214 provides that a HIGH is applied to the light emitting diodes 140 and 142 and photo transistors 144 and 146 only during the period of enable potential from output D which occurs during the payout operation.

More specifically in FIG. 10 the outputs A–F illustrate a sequence of operation whereby the drive shaft 30 is rotated from an arbitrary start point e.g. thirty degrees (30°) to a desired operating point e.g. three hundred and sixty degrees (360°) (indicate by 3′) during which the shaft 30 rotates in a clockwise direction showing all of the shaft encoder output combinations at outputs E and F as the apertures 130–135 in the driver gear 34 pass the light emitting diodes 140 and 142. The sequence is as follows:

1. The initial OFF condition is shown by LOW output states at outputs A-F as indicated by the output levels 220–230 respectively.

2. Clockwise rotation of shaft 30 is initiated by providing HIGH output states at outputs B and D as indicated by 232 and 234 respectively: HIGH states at shaft encoder outputs E and F, indicated by 236 and 238 respectively, identify the position of shaft 30 when said shaft is rotated from the sixty degree (60°) position through the three hundred and sixty degree (360°) position (1′ through 3′); the 3′ position is identified when the shaft encoder outputs E and F are HIGH together for the second time (236 and 238) and then returned to LOW. The high states at E and F occur when various of the apertures 130–135 come between light emitting diodes 140 and 142 and corresponding phototransistors 144 and 146 thereby directing the light to electrically switch the phototransistors 144 and 146 on (see FIG. 9 and FIGS. 5 and 6).

3. The fast motor stop condition results from providing a LOW at output B, indicated by 240, while maintaining a HIGH at output D, indicated by 234.

4. Counter-clockwise rotation of shaft 30 is initiated by providing a HIGH at output C indicated by 242 while maintaining the HIGH at output D as indicated by 234.

5. Clockwise rotation is started again by providing a HIGH 246 at output B while maintaining the HIGH 234 at output D.

(a) The outputs E and F will again go HIGH (236 and 238) as the shaft is rotated clockwise.

(b) When said outputs E and F go LOW as indicated by 248 and 250, output B is returned to a LOW 252 which stops the shaft rotation, with the payout slide returned to its start position.

6. After the shaft has been stopped, the outputs A and D are also made LOW as indicated by 254 and 256. This returns the drive shaft to non-engaged position and removes the braking potential to the drive shaft.

Other sequences and shaft encoding techniques may be utilized to accomplish the results of this payout system. It is feasible to use the sixth position to operate a sixth coin changer function in or outside of the housing, which may be different from the other five functions.

As will be readily understood, during latch engagement between a drive shaft pin and a selected latchable member, which is initiated by energizing of the solenoid 60, oscillation of the drive shaft 30 induces reciprocating motion into the associated payout slide and coins are dispensed from the associated coin tube until the motor 40 is turned at which time the solenoid is de-energized.

As clearly shown in FIG. 7 the payout slides 90–98 are disposed in overlapping relation in a transverse direction which provides a considerable cumulative space saving. The space savings is enchanced by the fact that in the embodiment shown the intermediate payout slides 92, 94 and 96 and the end slides 90 and 98 are all lapped by their adjacent slide or slides. The result of this structural arrangement of parts is that the cumulative widths of the payout slides i.e. the sum of the payout slide apertures 112 and side edges 113 of all of the slides 90–98, is greater than the transverse distance between the housing wall portions 101 adjacent the end slides 90 and 98, this structural arrangement providing a more compact assembly.

Figure 11:
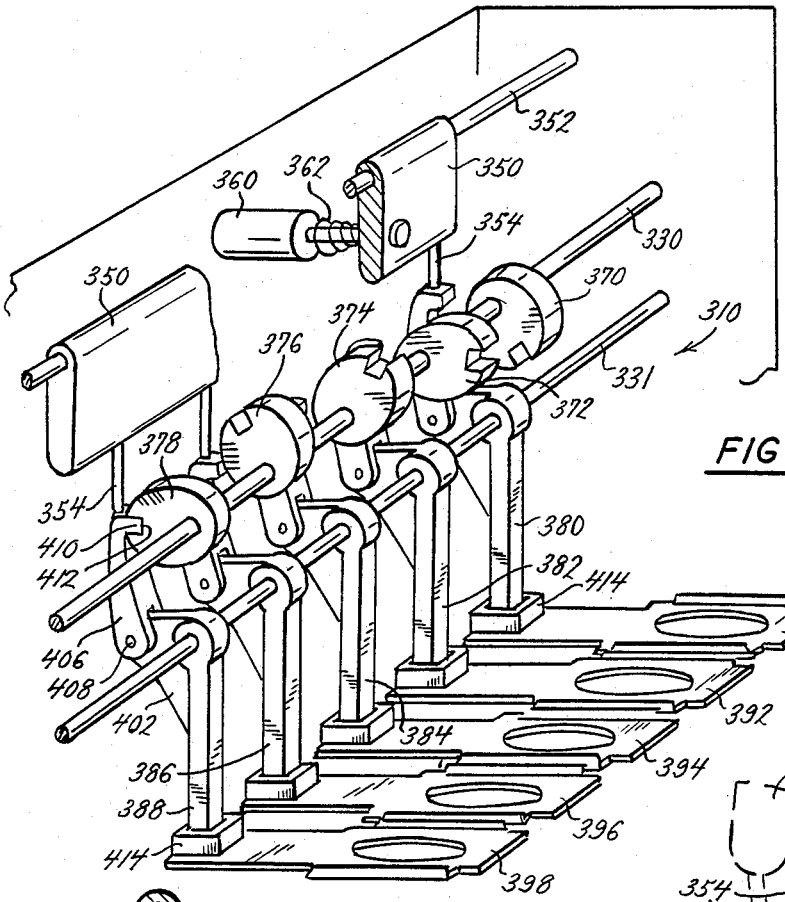
FIG. 11 is a perspective view showing a modified payout means.
Figure 13:
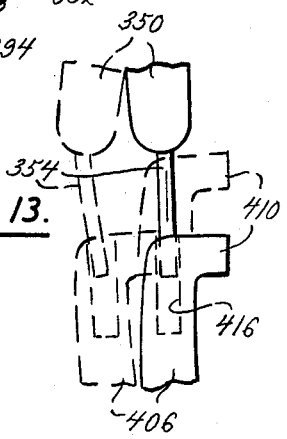
FIG. 13 is an enlarged detail of the latch mechanism of FIG. 12.
Figure 12:
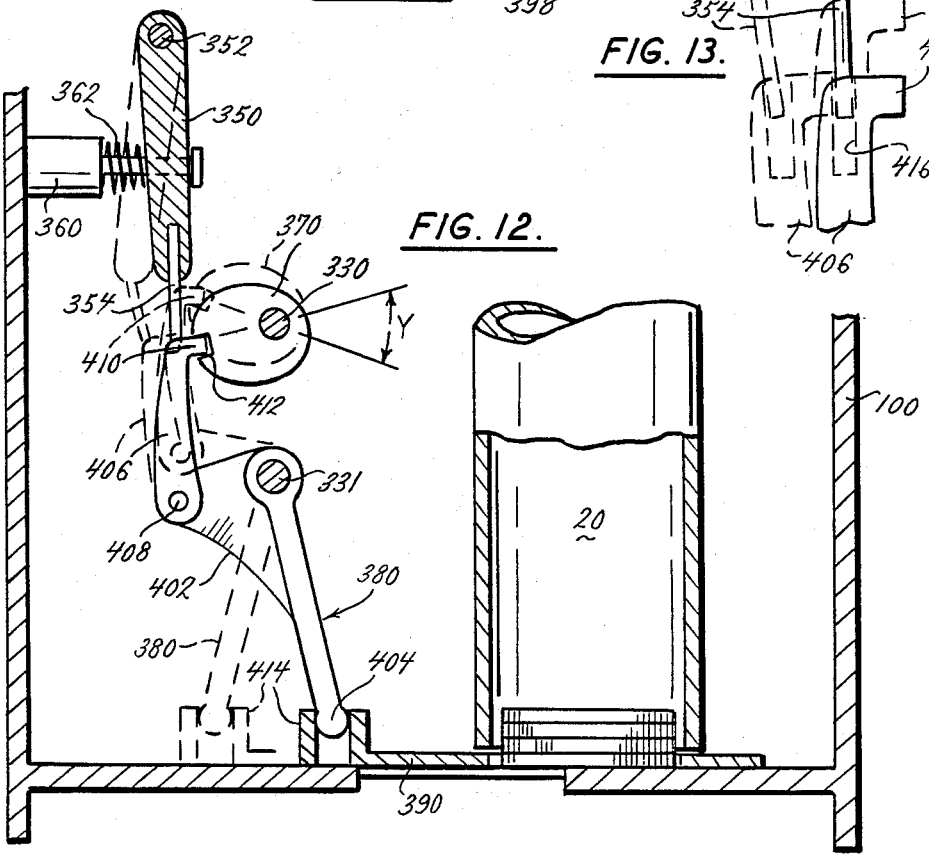
FIG. 12 is an elevational view of the modified system of FIG. 11.

In the embodiment described above a single drive shaft 30 is used carrying the latchable members, and latching is accomplished by shifting the drive shaft axially relative to said latchable members. FIGS. 11, 12 and 13 illustrate a modified arrangement providing an alternate or second embodiment in which two parallel shafts are used in conjunction with each other as will now be described.

It will be understood that the payout mechanism of the second embodiment, indicated by numeral 310 in FIGS. 11 and 12, is mounted in the lower portion of a coin changer housing 100 to service a plurality of coin changer storage tubes 20 by means of reciprocating payout slides 390–398 which are substantially identical to the storage tubes and payout slides of the first embodiment.

In the second embodiment, a drive shaft 330 is rotatably mounted to the housing having a plurality of latch elements provided by eccentric latch members 370, 372, 374, 376 and 378 fixedly attached thereto in longitudinally spaced relation along the axis of said shaft 330. A second, non-rotatable support shaft 331 is disposed in parallel relation to the first shaft and carries a plurality of latchable members 380, 382, 384, 386 and 388 freely mounted to said support shaft when not latch-engaged.

As shown in FIG. 11, the latchable members 380–388, exemplified by latchable member 380, are compound members each including an ell-shaped member 402 and a latch link 406 pivotally mounted to member 402 at 408. Each member 402 includes a downwardly extending leg and an outwardly extending leg, and each is apertured for pivotal mounting to the shaft 331 to provide a bell crank action. Member 402 includes a cammed end 404 received within the cam-receiving pocket 414 of the payout slide 390. Each of the upwardly extending latch links 406 mounted the outer leg of member 402 and has at its upper end a projecting latch part or dog 410 which is engageable within an associated latch slot 412 provided in each of the eccentric latch members. In this embodiment the latch slot 412 provides a first engagement means and said latch part 410 provides a second engagement means. The latch slot 412 of each latch member 370–378 is disposed at sixty degrees (60°) angular relation to the slot of the adjacent latch member. Because of this structural relationship of parts when the latch link dog 410 of one latchable member, eg member 380, is engaged within the slot 412 of an associated latch member 370 the other latch links 406 are disengaged from their associated slots 412.

The latchable member latch links 406 are conditioned for engagement with the eccentric latch members by means of an elongate positioning lever 350. Lever 350 is pivotally mounted at its upper end by means of pivot shaft 352 and includes at its lower end a plurality of spring-like fingers 354. As best shown in FIG. 13, the latch links 406 are each provided with a relatively deep opening 416 each receiving an associated spring finger 354. By this structural arrangement the positioning lever 350 remains connected to the individual links 406 even though there is relative vertical movement between associated fingers 354 and openings 416. The positioning lever 350 is operated by means of a solenoid 360 having a spring 362 in much the same way as in the first embodiment. As with the previous embodiment the latching of the selected latch element with its associated latchable member constitutes a connection means between the shaft 330 and the associated payout slide. Because of the eccentric nature of the latch members, and their angular relation to each other the latch dogs 410 which are not engaged within an associated latch slot 412 simply ride on the adjacent curved surface of the associated eccentric latch member.

It will be understood that the control system (not shown) is essentially the same as for the first embodiment and that when the selected actuating member link latch element 410 is aligned and engaged by the associated latch slot 412 and the shaft 330 is oscillated by a reversible D.C. motor, identical with the motor 40 of the first embodiment, an amount equal to angle Y the requisite reciprocating motion is induced into the associated payout slide to dispense coins from the associated storage tube as desired.

Another modified payout means is shown in FIGS. 14 and 15. This embodiment is similar in most respects to the embodiment described above with respect to FIGS. 1–7. It is distinguished in that, a more direct connection means is provided between the shaft and the payout slide. As shown the shaft 530 is provided with a plurality of elongate radially extending latch pins 570–578. These pins engage directly with payout slides 590–598. For example, pin 570 engages directly with payout slide 590 which is enlongated and includes a pair of cam-receiving wall elements 614 which receive the outer end of the pin therebetween. This embodiment, as will be readily understood requires greater space requirements in the housing 600 as compared with the more compact embodiment illustrated in FIGS. 1–7.

Three embodiments of the coin changer payout means have been described above in detail and those skilled in the art will appreciate that modifications may be made without departing from the spirit of this invention. For example, the extension of shaft 30 (330) outside of the housing 100 and provide an additional coin storage tube and associated payout mechanism is possible since it is known to locate additional coin storage tubes in this manner. In addition, a motor with appropriate connecting means can be used to shift the drive shaft. Also, as an alternative to the encoding means described, a Hall-effect transistor using magnetic encoding means can be used in lieu of the apertured gear and light emitting diode arrangement described. Further, inductive means can be used as well-known in the art. It will be readily understood also that the angular relationship attained of sixty degrees (60°) attained by using six pins is not intended as a limitation since more or less pins can be used as desired.

Therefore, it is not intended that the scope of the invention be limited to the specific embodiments illustrated and described. Rather, it is intended that the scope of this invention be determined by the appended claims and their equivalents.

I claim as my invention:

1. A coin changer payout means comprising:

(a) a plurality of coin storage tubes disposed in adjacent relation, (b) a plurality of reciprocable payout slides each payout slide being associated with a coin storage tube and being movable between a coin receiving position and a coin releasing position to discharge the coin, (c) a rotatable drive means, (d) a plurality of connection means, each of said connection means being selectively operatively connectible between said drive means and an associated payout slide, (e) means for rotating said drive means into a plurality of angularly related connectible conditions, each connectible condition being associated with a selected payout slide, (f) means for moving said drive means and the selected payout slide into connected engagement, (g) means for oscillating said drive means to reciprocate the selected payout slide, and (h) control means for controlling rotation and oscillation of said drive means and movement of said drive means and payout slide into the connected condition.

2. A coin changer payout means as defined in claim 1, in which:

(i) the control means includes encoding means rotatable with the drive means.

3. A coin changer payout means as defined in claim 1, in which:

(i) said coin storage tubes are disposed in a substantially straight row, and said payout slides include at least one intermediate slide having a slide on each side thereof disposed in lapped relation thereto at a different elevation to said intermediate slide.

4. A coin changer payout means as defined in claim 1, in which:

(i) the rotatable drive means is a drive shaft means.

5. A coin changer payout means as defined in claim 4, in which:

(j) the means for moving the drive shaft means and the selected payout means into connected engagement includes means shifting the shaft means relative to its longitudinal axis.

6. A coin changer payout means as defined in claim 5, in which:

(k) the shifting means includes a solenoid.

7. A coin changer payout means as defined in claim 4, in which:

(j) the control means includes encoding means rotatable with the drive shaft means and having a plurality of circumferentially disposed apertures and cooperating light emitting diodes on one side of said encoding means and photo transistors on the other side of said encoding means.

8. A coin changer payout means as defined in claim 7, in which:

(k) the motor means includes a reversible D.C. electric motor and transmission means between the motor and the drive shaft, said transmission means including a drive gear mounted to the drive shaft, and (l) said drive gear provides the encoding means.

9. A coin changer payout means as defined in claim 1, in which:

(i) the means for rotating and oscillating the drive means includes motor means.

10. A coin changer payout means as defined in claim 9, in which:

(j) the motor means includes a reversible D.C. electric motor and transmission means between the motor and the drive means.

11. A coin changer payout means as defined in claim 9, in which:

(j) the motor means includes a stepper motor.

12. A coin changer payout means comprising:

(a) a plurality of coin storage tubes disposed in adjacent relation, (b) a plurality of reciprocable payout slides each payout slide being associated with a coin storage tube and being movable between a coin receiving position and a coin releasing position to discharge the coin, (c) a rotatable drive means, (d) a plurality of connection means, each of said connection means being selectively operatively connectible between said drive means and an associated payout slide, (e) means for rotating said drive means into a connectible condition with a selected payout slide, (f) means for moving said drive means and the selected payout slide into connected engagement, (g) means for oscillating said drive means to reciprocate the selected payout slide, and (h) control means for controlling rotation and oscillation of said drive means and movement of said drive means and payout slide into the connected condition, (i) each connection means including a first engagement means, said first engagement means being disposed on the drive means in longitudinally spaced relation to each other and in selected angular relation to each other relative to the longitudinal axis of the drive means, and a second engagement means engageable with an associated payout slide and movable into connected engagement with the first engagement means by the moving means.

13. A coin changer payout means as defined in claim 12, in which:

(j) the means for moving the first and second engagement means into connected engagement includes a solenoid.

14. A coin changer payout means as defined in claim 12, in which:

(j) one of said first and second engagement means includes a latch element and the other of said first and second engagement means includes a latch slot receiving the latch element.

15. A coin changer as defined in claim 12, in which:

(j) the drive means includes a drive shaft means having a longitudinal axis, and a plurality of outwardly extending latch pins providing the first engagement and the second engagement means includes a latch slot receiving an associated latch pin.

16. A coin changer payout means as defined in claim 12, in which:

(j) the drive means includes a drive shaft means having a longitudinal axis, and (k) the means for moving the first engagement means into selected engagement with the second engagement means includes means shifting the drive shaft means longitudinally relative to the second engagement means, the shifting means including:

1. means fixedly attached to the drive means,
2. a pivoted positioning lever operatively engageable with said fixedly attached means, and
3. means operatively connected to the positioning lever to pivot said positioning lever.

17. A coin changer payout means as defined in claim 12, in which:

(j) the drive means includes a drive shaft means having a longitudinal axis, and (k) the second engagement means are mounted to the drive shaft means in freely rotatable relation when the first and second engagement means are disengaged.

18. A coin changer payout means as defined in claim 12, in which:

(j) the drive means includes a drive shaft means having a longitudinal axis, and (k) the drive shaft includes a plurality of outwardly extending eccentric latch members each having a latch portion providing a first engagement means and each second engagement means includes a link having a latch portion engageable with the latch portion of the first engagement means.

19. A coin changer payout means as defined in claim 18, in which:

(l) a separate shaft means is provided disposed in spaced parallel relation to the drive shaft means and the second engagement means are mounted to the separate shaft means in freely rotatable relation when the first and second engagement means are disengaged.

20. A coin changer payout means comprising:

(a) a plurality of coin storage tubes disposed in adjacent relation, (b) a plurality of reciprocable payout slides each payout slide being associated with a coin storage tube and being movable between a coin receiving position and a coin releasing position to discharge the coin, (c) a rotatable drive shaft means, (d) a plurality of connection means, each of said connection means being selectively operatively connectible between said drive shaft means and an associated payout slide, (e) means for rotating said drive shaft means into a connectible condition with a selected payout slide, (f) means for moving said drive shaft means and the selected payout slide into connected engagement, (g) means for oscillating said drive shaft means to reciprocate the selected payout slide, and (h) control means for controlling rotation and oscillation of said drive shaft means and movement of said drive shaft means and payout slide into the connected condition, (i) each connection means including a latch element said latch elements being disposed on the drive shaft means in longitudinally spaced relation to each other and in selected angular relation to each other relative to the longitudinal axis of the drive means and being movable into connected engagement with an associated payout slide by the moving means.

21. A coin changer payout means as defined in claim 20, in which:

(j) each latch element is provided by an outwardly extending pin and each payout slide includes a latch slot receiving an associated latch pin in connected engagement.

22. A coin changer payout means comprising:

(b) a plurality of coin storage tubes disposed substantially in a straight row in adjacent relation between said opposed sidewalls, (c) a plurality of reciprocable payout slides including opposed end slides and at least one intermediate slide, each payout slide including a coin-receiving aperture and a side portion on each side of said aperture, each payout slide being associated with a coin storage tube and being movable between a coin-receiving position and a coin-releasing position to discharge the coin, said intermediate slide having a slide on each side thereof having side portions disposed in lapped relation thereto at a different elevation to said intermediate slide, and means reciprocating said payout slides.

23. A coin changer payout means as defined in claim 22, in which:

(e) each sidewall includes a portion disposed closely adjacent a side portion of an end slide, and (f) the cumulative sum of the payout slide aperture diameters and the side portions of all slides is greater than the distance between said sidewall portions and adjacent side portions are disposed in operatively sliding relation to each other.

24. A coin changer payout means comprising:

(a) a plurality of coin storage tubes disposed in adjacent relation, (b) a plurality of reciprocable payout slides each payout slide being associated with a coin storage tube and being movable between a coin receiving position and a coin releasing position to discharge the coin, (c) a rotatable drive shaft means, (d) a plurality of connection means, each of said connection means being selectively operatively connectible between said drive means and an associated payout slide, (e) motor means for rotating said drive shaft means into a plurality of angularly related connectible conditions, each connectible condition being associated with a selected payout slide, (f) means for shifting said drive shaft means relative to its longitudinal axis for moving said drive shaft means and the selected payout slide into connected engagement, (g) said motor means providing means for oscillating said drive shaft means to reciprocate the selected payout slide, and (h) control means for controlling rotation and oscillation of said drive means and movement of said drive means and payout slide into the connected condition.

25. A coin changer payout means comprising:

(a) a plurality of coin storage tubes disposed in adjacent relation, (b) a plurality of reciprocable payout slides each payout slide being associated with a coin storage tube and being movable between a coin receiving position and a coin releasing position to discharge the coin, (c) a rotatable drive shaft means, (d) a plurality of connection means, each of said connection means being selectively operatively connectible between said drive means and an associated payout slide, including means offset from the longitudinal axis of said drive shaft means, (e) motor means for rotating said drive shaft means into a plurality of angularly related connectible conditions, each connectible condition being associated with a selected payout slide, (f) means for shifting said offset means transversely relative to the longitudinal axis for moving said offset means and the drive shaft means and the selected payout slide into connected engagement, (g) said motor means providing means for oscillating said drive shaft means to reciprocate the selected payout slide, and (h) control means for controlling rotation and oscillation of said drive means and movement of said drive means and payout slide into the connected condition.

* * * * *

UNITED STATES PATENT AND TRADEMARK OFFICE

CERTIFICATE OF CORRECTION

PATENT NO. : 4,834,689

DATED : May 30, 1989

INVENTOR(S) : Joseph L. Levasseur

It is certified that error appears in the above-identified patent and that said Letters Patent is hereby corrected as shown below:

Column 13, line 55, before "(b)" insert
--(a) a housing including opposed side walls,--

Signed and Sealed this

Eighteenth Day of September, 1990

*Attest:*

HARRY F. MANBECK, JR.

*Attesting Officer*

*Commissioner of Patents and Trademarks*